United States Patent [19]

Deschamps et al.

[11] 4,405,442

[45] Sep. 20, 1983

[54] PROCESS FOR CONVERTING HEAVY OILS OR PETROLEUM RESIDUES TO GASEOUS AND DISTILLABLE HYDROCARBONS

[75] Inventors: André Deschamps, Noisy le Roi; Sigismond Françkowiak; Jean-Francois Le Page, both of Rueil-Malmaison, all of France

[73] Assignee: Institut Francais Du Petrole, Rueil-Malmaison, France

[21] Appl. No.: 444,268

[22] Filed: Nov. 24, 1982

[30] Foreign Application Priority Data

Nov. 24, 1981 [FR] France ..... 81 21940

[51] Int. Cl.[3] ..... C10G 65/12; C10G 47/20

[52] U.S. Cl. ..... 208/107; 208/59; 208/950

[58] Field of Search ..... 208/59, 107, 950

[56] References Cited

U.S. PATENT DOCUMENTS

| | | | |
|---|---|---|---|
| 1,994,982 | 3/1935 | Cook | 208/107 |
| 2,461,153 | 2/1949 | Goldsby | 208/950 |
| 2,539,434 | 1/1951 | Keith | 208/107 |
| 2,698,830 | 1/1955 | Jenny . | |
| 3,369,994 | 2/1968 | Slater et al. . | |
| 3,907,920 | 9/1975 | Starks | 208/58 |
| 4,115,246 | 9/1978 | Sweany . | |
| 4,115,467 | 9/1978 | Fowler | 208/107 |
| 4,216,077 | 8/1980 | Chahvekilian et al. | 208/59 |

FOREIGN PATENT DOCUMENTS 1440407 6/1976 United Kingdom .

*Primary Examiner*—Delbert E. Gantz
*Assistant Examiner*—Lance Johnson
*Attorney, Agent, or Firm*—Millen & White

[57] ABSTRACT

This process for converting a charge of heavy oils or petroleum residues to gaseous and distillable hydrocarbons comprises the steps of (a) admixing said charge with a first hydrogenated recycle oil obtained in a subsequent step of the process, heating the mixture to 350°-450° C., admixing it with a reducing gas at a temperature of at least 800° C. and maintaining a temperature of 530°-850° C. and a pressure of at least 20 bars for 0.1 to 60 seconds (b) admixing the resultant product with a second hydrogenated recycle oil whose temperature is lower than 300° C., thereby decreasing the temperature of the resultant mixture to less than 450° C., then contacting it with a steam-hydrogen stream, thereby vaporizing at least 80% of the liquid to a gaseous phase (c) treating the unvaporized remaining fraction with oxygen and steam to form a reducing gas at a temperature of at least 800° C., used at least partly in step (a), (d) hydrogenating the gaseous phase from step (b) and recovering therefrom a light fraction distilling below 250° C., recycling at least partly the remaining gaseous phase to step (b) after removal of $CO_2$ and $H_2S$ therefrom and (e) recycling the remaining hydrogenated heavy oil fraction, distilling above 250° C., to steps (a) and (b).

7 Claims, 1 Drawing Figure

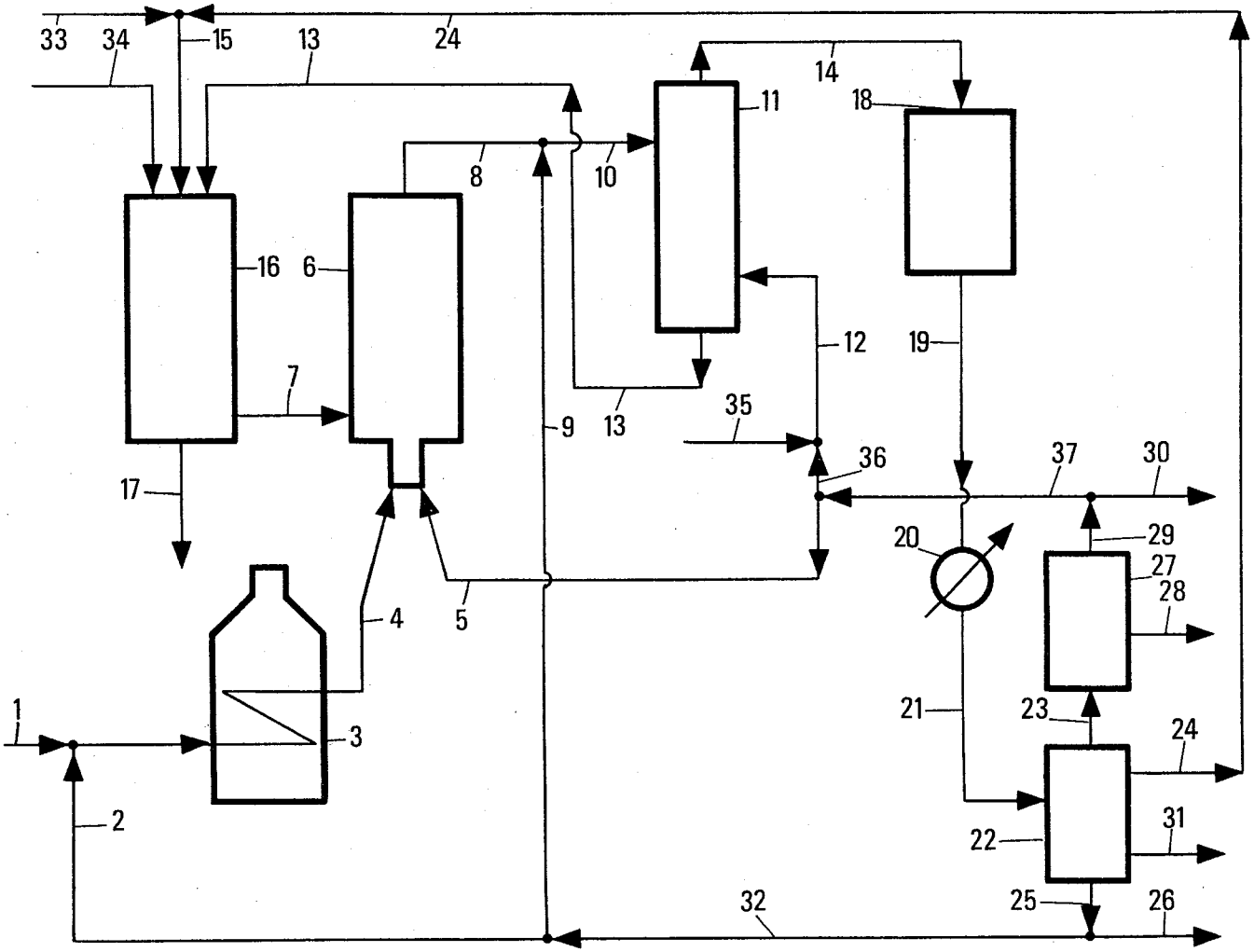
1
2
3
4
5
6
7
8
9
10
11
12
13
14
15
16
17
18
19
20
21
22
23
24
25
26
27
28
29
30
31
32
33
34
35
36
37

PROCESS FOR CONVERTING HEAVY OILS OR PETROLEUM RESIDUES TO GASEOUS AND DISTILLABLE HYDROCARBONS

BACKGROUND OF THE INVENTION

This invention concerns a process for producing gaseous hydrocarbons and distillates from heavy oils, atmospheric or vacuum residues, asphalts produced by deasphalting petroleum residues, bitumen extracted from bituminous sands or bituminous shale oils, by hydropyrolysis of said heavy oils in the presence of a previously hydrogenated recycle cut and of a gas containing hydrogen and carbon monoxide produced by oxyvapogasification of the hydropyrolysis heavy residue.

Many techniques for upgrading such heavy oils to lighter products have already been proposed.

The processes commonly used in petroleum refining involving a catalytic treatment in the presence of hydrogen, such as catalytic hydrocracking, are not convenient owing to the rapid poisoning of the catalysts by organometallic compounds and asphaltenes contained in said heavy charges.

The processes making use of a thermal treatment such as thermal cracking or cokefaction also are not convenient since they give a low yield of distillable hydrocarbons, moreover of bad quality, and a high yield of coke or tar difficult to upgrade.

Different solutions have been proposed to improve the quality of the formed products and to reduce the formation of coke or tar.

A first solution consists of effecting a thermal cracking in the presence of a hydrogen donor diluent containing partially hydrogenated polyaromatic hydrocarbons. This technique, known as "Hydrogen Donar Diluent Cracking" is described particularly in U.S. Pat. No. 2,953,513. Many patents describe variations of this technique. Thus, the U.S. Pat. No. 4,115,246 describes a process for cracking heavy oils in the presence of a hydrogen donor diluent, wherein the cracking products are separated into a gas oil fraction recycled after hydrogenation as hydrogen donor diluent and a residue or tar used for producing the hydrogen required for the oxyvapogasification. The operating conditions of the cracking step are generally a temperature from 370° to 538° C., a sufficient pressure to maintain a liquid phase and a residence time of 0.25 to 5 hours.

A second technique consists of effecting a quick heating of the carbonaceous material under hydrogen pressure (flash hydropyrolysis) followed with a quench so as to avoid reactions of recombination of the cracking products. The U.S. Pat. Nos. 2,875,150 and 3,855,070 describe two ways of making use of this principle. The cracking is generally effected at a temperature from 600° to 900° C., under a pressure higher than 5 bars and for a residence time lower than 10 seconds.

In spite of the improvements brought by these innovations, the amounts of formed residue, coke or tar, remain high as compared to the yield of the desired light products. Moreover, the adopted technological solutions, particularly as concerns the quick heating of the charge, are heavy and/or expensive in power consumption.

The process of the invention avoids these disadvantages and provides means for converting a heavy oil or a petroleum residue to gaseous products and distillates with an optimized yield in terms of the consumed power.

BRIEF DESCRIPTION OF THE DRAWING

The FIGURE is a schematic diagram of one embodiment of the process of the invention.

SUMMARY OF THE INVENTION

The process of the invention comprises the following steps:

(a) a mixture of a heavy oil charge and/or a petroleum residue with a first fraction of hydrogenated recycle oil issued from step (g) is brought to 350°–450° C., and then admixed with a reducing gas containing hydrogen, carbon monoxide and steam, admitted at a temperature of at least 800° C. and issued at least partly from step (c), so as to bring the temperature of the resultant mixture charge+gas within the range from 530° to 850° C., and said mixture is maintained within said temperature range, under a pressure of at least 20 bars for 0.1 to 60 seconds.

(b) the resultant product from step (a) is admixed with a second hydrogenated recycle oil fraction issued from step (g) and whose temperature is lower than 300° C., so as to lower the temperature of said product from said value ranging between 530° and 580° C. down to a temperature lower than 450° C., and then the resultant product is directly contacted with a gas stream containing hydrogen and steam, obtained from step (f), so as to vaporize at least 80% of the existing liquid at a temperature lower than 450° C., the resultant gaseous phase being separated from an unvaporized fraction of tar and/or coke.

(c) the heavy fraction of tar and/or coke is treated with oxygen and steam under the conditions of oxyvapogasification of carbon, so as to convert it, at least partly, to a reducing gas containing hydrogen, carbon monoxide and steam, at least one part of said reducing gas, whose temperature is at least 800° C., being fed back to step (a), (d) the gaseous phase from step (b), containing hydrogen, carbon monoxide, carbon dioxide, steam and hydrocarbon vapors, is passed over a hydrogenation catalyst under hydrogenating conditions, (e) the products from step (d) are fractionated to a gaseous phase, an aqueous phase, a fraction of light liquid hydrocarbons normally distilling, at least in major part, below 250° C., and a fraction of heavy liquid hydrocarbons distilling, at least in major part, above 250° C. and having an atomic ratio H/C from 1.2 to 1.7.

(f) the gaseous phase from step (e) is so treated as to remove at least the major part of the carbon dioxide and the hydrogen sulfide contained therein and at least a part thereof is recycled to step (b), and (g) at least a portion of the heavy fraction, distilling in a major part above 250° C., as obtained in step (e) is recycled to steps (a) and (b) to form at least a part of said hydrogenated recycle oil streams.

DETAILED DISCUSSION

This process offers several advantages as compared with the prior art techniques.

Thus, the sensible heat contained in the raw reducing gas issued from the residue gasification zone at a temperature from 800° to 1500° C., is used to quickly bring to the desired temperature the heavy oil charge and the recycle oil in the hydropyrolysis reactor (step a), thereby providing for a substantial power saving.

The recycling, after hydrogenation, of a part of the heavy fraction of the produced hydrocarbons, makes it possible to substantially decrease the amount of tar and/or coke in the hydropyrolysis step and to improve the yield to the desired noble products.

The abrupt chilling of the hydropyrolysis products in the presence of hydrogenated recycle oil, associated to the stripping of the heavy products by means of a hydrogen containing gas, provides for the blocking of the repolymerization reactions and for an efficient separation of the heavy products from the vaporizable hydrocarbons fed to a catalytic hydrotreatment step. Moreover, the temperature of said effluent may easily be maintained at a sufficient level to effect the hydrotreatment, thereby avoiding the need of heating means.

Moreover, the catalytic hydrotreatment is effected by means of reducing gases not consumed in the hydropyrolysis step. In fact, as a result of the presence of steam, carbon monoxide is at least partially converted to hydrogen and carbon dioxide in the hydropyrolysis and the catalytic hydrotreatment steps. This integration of the hydrogen production necessary to the process provides for substantial investment and power savings.

A more detailed description of the process of the invention, as illustrated by the accompanying drawing, is given hereinafter by way of a non-limitative example of an embodiment of the invention.

The heavy oil charge or petroleum residue is introduced through line 1 in the preheating oven 3 after admixture with the hydrogenated recycle oil fed through line 2. The ratio by weight recycle oil/charge is usually from 0.1 to 3, preferably from 0.2 to 2. The recycle oil has a boiling point, under normal conditions, generally higher than 250° C. and an atomic ratio H/C from 1.2 to 1.7. The mixture is brought, in pre-heater 3, to a temperature from 350° to 450° C. under a pressure of at least 20 bars, for example from 20 to 200 bars. In order to avoid coke formation, it is convenient to operate under the highest possible pressure. However the integration of that step in the whole process generally leads to operating at a pressure close to and slightly higher than that of the next hydropyrolysis step. An injection of hydrogen-containing recycle gas may optionally be effected before the introduction into the oven.

The pre-heated mixture is fed through line 4 into the hydropyrolysis reactor 6 where it meets the raw reducing gas introduced through line 7 at a temperature from 800° to 1500° C. A secondary injection of hydrogen-containing recycle gas may also be effected through line 5 in order to atomize the liquid charge at the reactor inlet. The hydropyrolysis reactor preferably operates under autothermal conditions at a temperature from 530° to 850° C., preferably from 550° to 800° C., under a pressure from 20 to 150 bars. The temperature may be maintained within the desired range by adjusting the temperatures and the feeding rates. Different types of reactors may be used, particularly reactors with a fluidized bed or with a driven moving bed involving circulation of solid particles. Preferably, the reactor is of the flash pyrolysis type comprising a device for admixing the feeds and a vacuum reaction chamber. The residence time of the reactants in the reactor is from 0.1 to 60 seconds, preferably from 0.5 to 20 seconds. Of course, the hydropyrolysis may be effected by making use of a purified hydrogen stream, in addition to the raw synthesis gas. However, it is preferable not to use the latter for the sake of economy. The hydropyrolysis reactor effluent discharged through line 8 is cooled down to a temperature from 350° to 450° C. by direct contact with a hydrogenated recycle oil injected through line 9. This oil has the same characteristics as that used for diluting the charge and is supplied from the fractionation zone 22. In addition to its cooling effects, this oil has the effect of stabilizing the pyrolysis products by limiting the condensation of some fragments, probably by hydrogen transfer, and thus contributes to minimize the formation of heavy products. The mixture is then introduced through line 10 to the separator 11 at the bottom of which is injected, through line 12, a mixture of overheated steam fed through line 35 and of a hydrogen-containing recycle gas issued from the washing zone 27 through line 29, 37 and 36. These gases thus meet, preferably counter-currently, the liquid and/or solid heavy products flowing down towards the bottom of the column and are discharged through line 13, this favouring the vaporization of the vaporizable hydrocarbons and reducing to a minimum the residue amount. The gases containing hydrocarbon vapors are discharged at the top to the apparatus through line 14. The separator 11 consists, for example, of a column provided with baffles favoring the contact between the phases while permitting the residue to flow. The temperature is from 350° to 450° C. and the pressure substantially the same as in the hydropyrolysis step.

The heavy residue, of liquid or solid type according to the operating conditions, and containing the major part of the metals of the charge, is conveyed through line 13 to the gasification reactor 16 where it is contacted with oxygen and water or steam, respectively introduced through lines 34 and 15, under the conditions of the oxyvapogasification of the carbonaceous material, i.e. for example 800°–1500° C. and 1–200 bars.

When the amount of available heavy residue is insufficient to produce the hydrogen and carbon monoxide reducing gases necessary for the whole process, it is of course possible to make use of an additional carbonaceous material. In this case, it is preferred to make use of a gaseous mixture containing methane, ethane, carbon monoxide and hydrogen, withdrawn through line 30.

The water injected into line 15 comes from an external supply through line 33 but may also be partly issued from a recycling through line 24 of the water recovered in the fractionation zone 22. The gasification is preferably effected at a pressure close to or slightly higher than that of the hydropyrolysis step, so as to provide for the direct injection of hot gases, at a temperature from 800° to 1500° C., into reactor 6, through line 7. At least a partial separation of the ashes containing the metals of the charge and unconverted carbon is effected from the bottom of gasifier 16. The latter are discharged through line 17. Any oxyvapogasification process with a good conversion rate of the residual carbonaceous material can be used, for example the systems with fluidized bed, with driven flow or with melting bath.

It is also possible to integrate in the same reactor the hydropyrolysis zones 6, the separation zone 11 and the residue oxyvapogasification zone 16, for example with a system of circulating fluidized beds.

The gases loaded with condensable hydrocarbon vapors and further containing, in particular, hydrogen, carbon monoxide, carbon dioxide, steam, methane and ethane conveyed through line 14, are introduced into the catalytic hydrogenation reactor 18 containing a catalyst of the type used for the hydrogenation, the hydrodesulfurization or the hydrocracking of oil fractions; these catalysts consist for example of compounds of Co, Mo, Ni and/or W deposited on alumina, silica and/or silica-alumina carriers.

The temperature and the pressure are generally close to those of the separator 11, i.e. respectively temperatures from 350° to 450° C., and pressures from 20 to 150 bars. The space velocity, calculated with respect to the condensable hydrocarbons present in the reactor feed charge, is from 0.1 to 2 volumes/volume/hour.

According to the severity of the operating conditions, the hydrocarbons undergo a hydrogenation, a desulfurization or a more or less complete hydrocracking. These conditions are generally so selected that the fraction having a normal boiling point higher than 250° C., separated at 22, has an atomic ratio H/C from 1.2 to 1.7. Due to the removal of the major part of the metal compounds in the residue separated at 11, the catalyst has a good stability during time.

Simultaneously with the above mentioned reactions, the catalyst produces the conversion of a substantial proportion of the carbon monoxide present in the gas, to hydrogen and carbon dioxide, by reaction with steam. In order to favor this reaction, the molar ratio $H_2O/CO$ in the feed charge of reactor 18 is maintained between 0.8 and 1.2 by adjusting the feed rate of steam injected through line 35.

The products issuing from reactor 18 through line 19 are cooled in exchanger 20, expanded to a pressure close to the atmospheric pressure, and then introduced through line 21 into the fractionation zone 22. They are fractionated to a gaseous phase essentially containing hydrogen, carbon dioxide, carbon monoxide, hydrogen sulfide, methane and ethane, discharged through line 23; an aqueous phase recycled through line 24 to the oxyvapogasification reactor 16; a phase of light liquid hydrocarbons having a normal boiling point generally lower than 250° C., for example from 30° to 250° C., withdrawn through line 31 and a phase of heavy liquid hydrocarbons of normal boiling point generally higher than 250° C., withdrawn through line 25. At least a part of this fraction is recycled through line 32 as diluent for the heavy oil charge (line 2) and as cooling liquid for the hydropyrolysis products (line 9). The excess is discharged through line 26.

The gases discharged through line 23 are introduced into the washing zone 27 wherefrom are separated, by known methods, at least the major part of the carbon dioxide and of the hydrogen sulfide, discharged through line 28. The purified effluent, formed in major part of hydrogen, carbon monoxide, methane and ethane, is withdrawn, through line 29 and separated into two streams: a first stream is withdrawn through line 30, the second is recycled through line 37, on the one hand to the inlet of the hydropyrolysis reactor as atomization gas for the charge (line 5), on the other hand towards the bottom of the separator 11 as driving gas (line 36).

The gaseous mixture withdrawn through line 30 may obviously be fractionated to recover the gaseous hydrocarbons and recycle the hydrogen and carbon monoxide to the catalytic hydrogenation zone 18. It can also be treated over a catalyst for methanation of carbon monoxide so as to obtain a natural gas substitute. Generally, it is preferred to recycle it, without preliminary fractionation, to the gasification reactor 16 wherein methane and ethane are converted to carbon monoxide and hydrogen by reaction with oxygen and steam.

EXAMPLE

This is a non limitative example of embodiment of the invention illustrated by the diagram of the accompanying drawing.

The charge consists of a straight-run residue of a Boscan heavy oil.

The characteristics of the charge and of the obtained liquid products are reported in table 1.

TABLE 1

| | Charge | Light oil (line 31) | Heavy oil (line 25) |
|---|---|---|---|
| Specific gravity 20/20° C. | 1.018 | 0.842 | 0.925 |
| S % b.w | 5 | 0.5 | 0.8 |
| N % b.w | 0.75 | 0.03 | 0.08 |
| atomic ratio $\frac{H}{C}$ | 1.4 | 1.9 | 1.53 |
| vanadium ppm b.w | 1205 | 0 | 2 |
| nickel ppm b.w | 116 | 0 | 0.5 |
| Conradson carbon % b.w | 17 | 0 | 1.8 |
| initial boiling point °C. (1) | 350 | 40 | 250 |
| final boiling point °C. (1) | | 250 | 500 |
| residue 525° C. % b.w | 66 | 0 | 0 |
| % b.w of the charge | | 61 | 24.9 |

(1) corresponding to the atmospheric pressure

The residue time of the reactants in the hydropyrolysis reactor 6 is about 8 seconds.

The operating pressure in apparatus 3, 6, 11 and 18 is about 95 bars. The catalytic hydrogenation reactor 18 contains 200 l of catalyst containing nickel and tungsten on an alumina carrier. The gas separated at 22 through line 23 is washed in column 27 by means of an aqueous solution of monoethanolamine so as to separate carbon dioxide and hydrogen sulfide contained therein. The gas withdrawn through line 30 is used with the residue conveyed through line 13, to produce the reducing gas in the gasifier 16.

The other operating conditions and the results are reported in table II.

These results show that the process according to the invention provides for a conversion, with a high yield, of a heavy oil residue to distillates of good quality.

TABLE II

| Constituents | Reference N° of line or apparatus | T °C. | Flow rate kg/h | Composition % by volume $H_2$ | CO | $CO_2$ | $H_2S$ | $H_2O$ | $CH_4$ | $C_2H_6$ |
|---|---|---|---|---|---|---|---|---|---|---|
| Charge | 1 | | 100 | | | | | | | |
| Recycle oil | 2 | | 50 | | | | | | | |
| Recycle oil | 9 | 100 | 55 | | | | | | | |
| Reducing gas | 7 | 1400 | (60)* | 56 | 29 | 9 | 0.4 | 5.6 | | |
| Steam | 35 | 350 | 16 | | | | | | | |
| Recycle gas | 36 | 350 | (60)* | 55 | 10 | | | 5 | 21 | 9 |
| Residue | 13 | | 7.2 | | | | | | | |
| Water | 15 | | 4 | | | | | | | |

TABLE II-continued

| Constituents | Reference N° of line or apparatus | T °C. | Flow rate kg/h | Composition % by volume $H_2$ | CO | $CO_2$ | $H_2S$ | $H_2O$ | $CH_4$ | $C_2H_6$ |
|---|---|---|---|---|---|---|---|---|---|---|
| Water | 24 | | 3.5 | | | | | | | |
| Oxygen | 34 | | (11.9)* | | | | | | | |
| Gas | 30 | | 20.5 | 55 | 10 | | | 5 | 21 | 9 |
| $CO_2 + H_2S$ | 28 | | (13)* | | | 75 | 25 | | | |
| Light oil | 31 | | 61 | | | | | | | |
| Heavy oil | 26 | | 24.9 | | | | | | | |
| | 3 | 420 | | | | | | | | |
| | 6 | 580 | | | | | | | | |
| | 10 | 420 | | | | | | | | |
| | 11 | 400 | | | | | | | | |
| | 18 | 400 | | | | | | | | |
| | 16 | 1400 | | | | | | | | |

*flow rate expressed in $Nm^3/h$.

What is claimed is:

1. A process of the conversion of heavy oil or oil residue to gaseous and distillable hydrocarbons, comprising the steps of:

(a) heating to 350°–450° C. a mixture of a heavy oil and/or oil residue charge with a first hydrogenated recycle oil fraction issued from step (g), then admixing it with a reducing gas containing hydrogen, carbon monoxide and steam, introduced at a temperature of at least 800° C. and produced at least partly in step (c), so as to bring the temperature of the resultant mixture charge+gas to a value ranging from 530° to 850° C., and maintaining said mixture within said temperature range, under a pressure of at least 20 bars, for a residence time between 0.1 and 60 seconds, (b) admixing the resultant product from step (a) with a second hydrogenated recycle oil fraction issuing from step (g) and whose temperature is lower than 300° C., so as to lower the temperature of said product from said value ranging between 530° and 850° C. down to a value lower than 450° C., then directly contacting the resultant product with a gas stream containing hydrogen and steam, obtained from step (f), so as to vaporize at least 80% of the existing liquid at a temperature lower than 450° C., and separating the resultant gaseous phase from an unvaporized tar and/or coke fraction, (c) treating the heavy fraction of tar and/or coke with oxygen and steam, under the conditions of oxyvapogasification of carbon to convert it at least partly to a reducing gas containing hydrogen, carbon monoxide and steam and feeding back at least a part of said reducing gas, whose temperature is at least 800° C., to step (a), (d) passing the gaseous phase from step (b) containing hydrogen, carbon monoxide, carbon dioxide, steam and hydrocarbon vapors, over a hydrogenation catalyst, under hydrogenating conditions, (e) fractionating the products from step (d) to a gaseous phase, an aqueous phase, a fraction of light liquid hydrocarbons normally distilling, at least in major part, below 250° C., and a fraction of heavy liquid hydrocarbons distilling, at least in major part, above 250° C. and whose atomic ratio H/C is from 1.2 to 1.7, (f) treating the gaseous phase from step (e) so as to remove therefrom at least the major part of the carbon dioxide and hydrogen sulfide contained therein and recycling at least a part of it to step (b), and (g) recycling to steps (a) and (b) at least a part of the heavy fraction, distilling in major part above 250° C., obtained in step (e), to constitute at least a portion of said hydrogenated recycle oil streams.

2. A process according to claim 1, wherein, in step (d), the molar ratio $H_2O/CO$ of the gaseous phase passing over the hydrogenation catalyst is maintained between 0.8 and 1.2.

3. A process according to claim 1, wherein the ratio by weight recycle oil/charge in step (a) is from 0.2 to 2.

4. A process according to claim 1, wherein recycle gas from step (f) is fed to step (a), so as to be present during the heating upto 350°–450° C.

5. A process according to claim 1, wherein the residence time in step (a) is from 0.5 to 20 seconds.

6. A process according to claim 1, wherein, in step (d), the temperature is from 350° to 450° C. the pressure is from 20 to 150 bars, and the hydrogenation catalyst contains at least one compound of cobalt, molybdenum, nickel and/or tungsten.

7. A process according to claim 1, wherein, in step (b) the vaporization is effected at 350°–450° C.

* * * * *